US009770905B2

(12) United States Patent
Date

(10) Patent No.: US 9,770,905 B2
(45) Date of Patent: Sep. 26, 2017

(54) LIQUID EJECTING APPARATUS AND CONTROL METHOD AND PROGRAM OF LIQUID EJECTING APPARATUS

(71) Applicant: SEIKO EPSON CORPORATION, Tokyo (JP)

(72) Inventor: Kyohei Date, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/859,994

(22) Filed: Sep. 21, 2015

(65) Prior Publication Data

US 2016/0082724 A1 Mar. 24, 2016

(30) Foreign Application Priority Data

Sep. 24, 2014 (JP) ..... 2014-193553

(51) Int. Cl.

| | |
|---|---|
| ***B41J 29/38*** | (2006.01) |
| ***B41J 2/045*** | (2006.01) |
| ***B41J 2/14*** | (2006.01) |
| ***B41J 2/145*** | (2006.01) |
| ***B41J 2/21*** | (2006.01) |

(52) U.S. Cl.

CPC ..... *B41J 2/04581* (2013.01); *B41J 2/0453* (2013.01); *B41J 2/04541* (2013.01); *B41J 2/04573* (2013.01); *B41J 2/04588* (2013.01); *B41J 2/04593* (2013.01); *B41J 2/04596* (2013.01); *B41J 2/145* (2013.01); *B41J 2/14233* (2013.01); *B41J 2/2146* (2013.01); *B41J 2002/14241* (2013.01)

(58) Field of Classification Search

None

See application file for complete search history.

(56) References Cited

U.S. PATENT DOCUMENTS

| | | | | |
|---|---|---|---|---|
| 6,793,319 | B2 | 9/2004 | Ikemoto et al. | |
| 2006/0082617 | A1* | 4/2006 | Nagashima | B41J 2/0451 347/68 |
| 2012/0019581 | A1* | 1/2012 | Miura | B41J 2/16585 347/14 |
| 2013/0002769 | A1* | 1/2013 | Koseki | B41J 2/14209 347/71 |

FOREIGN PATENT DOCUMENTS

| | | |
|---|---|---|
| JP | 2002-103597 | 4/2002 |

* cited by examiner

*Primary Examiner* — Erica Lin

(74) *Attorney, Agent, or Firm* — Foley & Lardner LLP

(57) ABSTRACT

A liquid ejecting apparatus includes a wiring substrate; and a liquid ejecting head, in which the liquid ejecting head includes a plurality of electrodes, an ejecting unit, and a non-ejecting unit, the wiring substrate is connected to the plurality of electrodes, the ejecting unit includes a driven element which is displaced due to a signal waveform applied to an electrode which is provided so as to correspond to at least one of the plurality of electrodes, a pressure chamber, and nozzles, the non-ejecting unit is provided so as to correspond to at least another electrode among the plurality of electrodes, and does not include at least one of the nozzle, the driven element, and the pressure chamber, and the signal waveform which is applied to an electrode which corresponds to the non-ejecting unit is designated by a dummy signal in the printing data.

6 Claims, 15 Drawing Sheets

<OBLIQUE HEAD>

<DECODING CONTENTS OF DECODER>

| PRINTING DATA SI | T1 | | T2 | |
|---|---|---|---|---|
| | Sa | Sb | Sa | Sb |
| (1, 1) | H | L | H | L |
| (0, 1) | H | L | L | H |
| (1, 0) | L | L | L | H |
| (0, 0) | L | H | L | L |

UPPER LOWER

<STRAIGHT DOT>

LIQUID EJECTING APPARATUS AND CONTROL METHOD AND PROGRAM OF LIQUID EJECTING APPARATUS

The entire disclosure of Japanese Patent Application No. 2014-193553, filed Sep. 24, 2014 is expressly incorporated by reference herein.

BACKGROUND

1. Technical Field

The present invention relates to a liquid ejecting apparatus, and a control method and a program of the liquid ejecting apparatus.

2. Related Art

As an apparatus which prints an image or a document by ejecting liquid such as ink, an apparatus in which a piezoelectric element (for example, piezo element) is used has been known. The piezoelectric element is provided so as to correspond to respective a plurality of nozzles in a liquid ejecting head, ejects a predetermined amount of ink from the nozzle at a predetermined timing by being respectively driven according to a driving signal, and thereby forms dots in this manner.

As a technology which is applied to such a printing apparatus, for example, a technology in which nozzle columns are obliquely arranged with respect to an orthogonal direction of a transport direction of a printing medium a liquid ejecting head (head chip), and deterioration in quality of a printing result is suppressed has been known (refer to JP-A-2002-103597).

Meanwhile, in the liquid ejecting head, there is a case in which nozzles are provided (ejecting unit is provided) or, in contrast, nozzles are not provided without being opened (non-ejecting unit is provided) due to various reasons such as a specification. In such a case, a problem such that driving signals are not appropriately transmitted to the ejecting unit and the non-ejecting unit is assumed.

SUMMARY

An advantage of some aspects of the invention is to solve a problem when an ejecting unit and a non-ejecting unit are mixed in a liquid ejecting apparatus.

According to an aspect of the invention, there is provided a liquid ejecting apparatus which includes a wiring substrate, and a liquid ejecting head, in which the liquid ejecting head includes a plurality of electrodes, an ejecting unit, and a non-ejecting unit, the wiring substrate is connected to the plurality of electrodes, and a signal waveform in which predetermined printing data is designated is applied to the electrodes through the wiring substrate, the ejecting unit includes a driven element which is displaced due to a waveform of a signal applied to an electrode which is provided so as to correspond to at least one of the plurality of electrodes, a pressure chamber of which an internal volume is changed due to the displacement of the driven element when the inside is filled with liquid, and nozzles which are provided in order to eject liquid in the pressure chamber according to the change in internal volume of the pressure chamber, the non-ejecting unit is provided so as to correspond to at least another electrode among the plurality of electrodes, and does not include at least one of the nozzle, the driven element, and the pressure chamber, and the plurality of electrodes are arranged at a predetermined pitch along a predetermined direction, and a signal waveform which is applied to an electrode which corresponds to the non-ejecting unit is designated by a dummy signal in the printing data.

According to the liquid ejecting apparatus, it is possible to appropriately apply a signal waveform to a corresponding electrode even when an electrode which corresponds to the ejecting unit which ejects liquid, and an electrode which corresponds to the non-ejecting unit which does not eject liquid are mixed in the plurality of electrodes, and there is no erroneous ejection. In addition, in the liquid ejecting apparatus, it is possible to share the wiring substrate even when an electrode which corresponds to the non-ejecting unit is changed.

The liquid ejecting apparatus may have a configuration in which a control unit and a distribution unit are further included, the control unit outputs the printing data by multiplexing the data, the distribution unit distributes the multiplexed printing data to each of the ejecting unit and the non-ejecting unit, respectively, and a signal waveform corresponding to the distributed printing data is applied to each of the electrode which corresponds to the ejecting unit, and the electrode which corresponds to the non-ejecting unit. According to the configuration, it is possible to appropriately apply a signal waveform to a corresponding electrode, and to suppress erroneous ejection even when the electrode which corresponds to the ejecting unit, and the electrode which corresponds to the non-ejecting unit are simply distributed without being recognized.

In the liquid ejecting apparatus, it is preferable that the signal waveform which is designated by the predetermined dummy signal does not displace the driven element, or causes the driven element to be minutely vibrated. It is possible to prevent ejecting of liquid from nozzles even when the non-ejecting unit includes the nozzles.

The liquid ejecting apparatus may have a configuration in which the nozzles are arranged along a first direction which intersects an orthogonal direction of a transport direction of a printing medium onto which the liquid is ejected. According to the configuration, it is possible to perform high resolution printing since the arrangement of the nozzles is inclined to the orthogonal direction of the transport direction of the printing medium.

In the configuration, the nozzles may be arranged in two columns of a first group and a second group along the first direction, and the nozzles of the first group and the nozzles of the second group may be located on a virtual line along a direction in which the printing medium is transported. In this manner, it is possible to eject liquid from the nozzles which are arranged in two columns of the first group and the second group, and to cause the liquid to be overlapped with each other on the printing medium.

In addition, the invention can be executed in various modes, and can be considered as, for example, a control method of a liquid ejecting apparatus, and a program, or the like, which causes a computer to function as a control method of the liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments for executing the invention will be described with reference to drawings.

Figure 1:
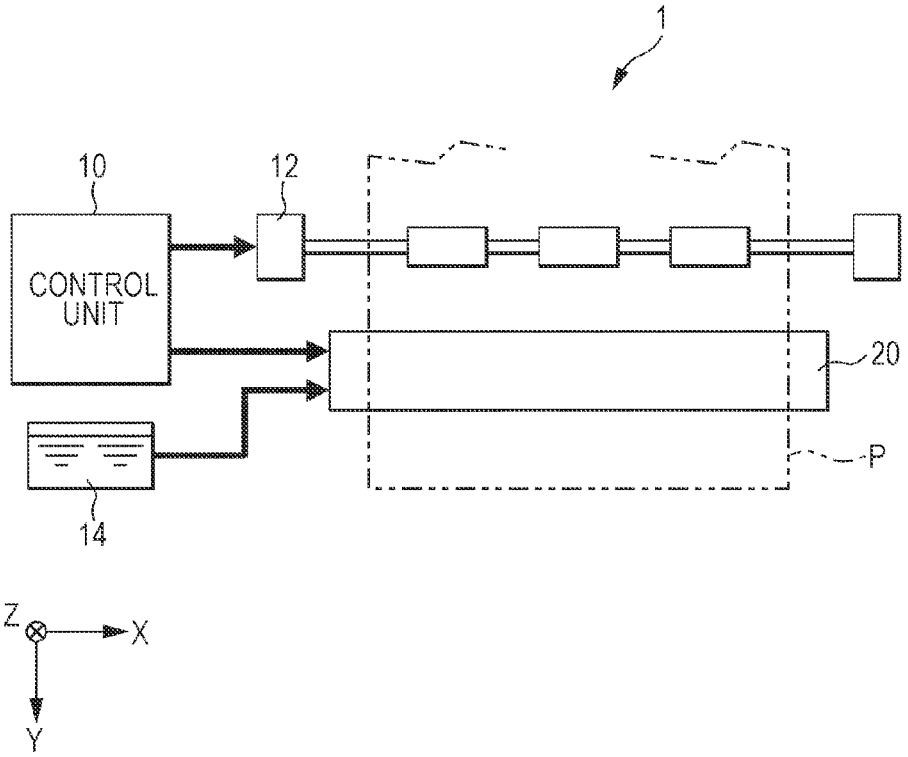
FIG. 1 is a diagram which illustrates a schematic configuration of a printing apparatus according to an embodiment.

FIG. 1 is a diagram which illustrates a partial configuration of a printing apparatus 1 according to an embodiment.

The printing apparatus 1 is a liquid ejecting apparatus (ink jet printer) which forms an ink dot group on a printing medium P such as paper by ejecting ink (liquid) according to image data which is supplied from an external host computer, and prints an image (including characters, figures, or the like) corresponding to the image data.

As illustrated in the figure, the printing apparatus 1 includes a control unit 10, a transport mechanism 12, and a liquid ejecting module 20. In addition, on the printing apparatus 1, a liquid container (cartridge) 14 which stores ink of a plurality of colors is mounted. In the example, inks of four colors in total of cyan (C), magenta (M), yellow (Y), and black (Bk) are stored in the liquid container 14.

The control unit 10 controls each element of the printing apparatus 1 as will be described later. The transport mechanism 12 transports the printing medium P in the Y direction under a control of the control unit 10. The liquid ejecting module 20 ejects ink which is stored in the liquid container 14 onto the printing medium P under a control of the control unit 10. The liquid ejecting module 20 in the embodiment is a line head which is long in the X direction which intersects the Y direction (typically orthogonal).

In the printing apparatus 1, a desired image is formed on the surface of the printing medium P when the liquid ejecting module 20 ejects ink onto the printing medium P in synchronization with transporting of the printing medium P using the transport mechanism 12.

In addition, hereinafter, a direction which is orthogonal to an X-Y plane (plane parallel to surface of printing medium P) is denoted by a Z direction. Typically, the Z direction is an ejecting direction of ink using the liquid ejecting module 20.

Figure 2:
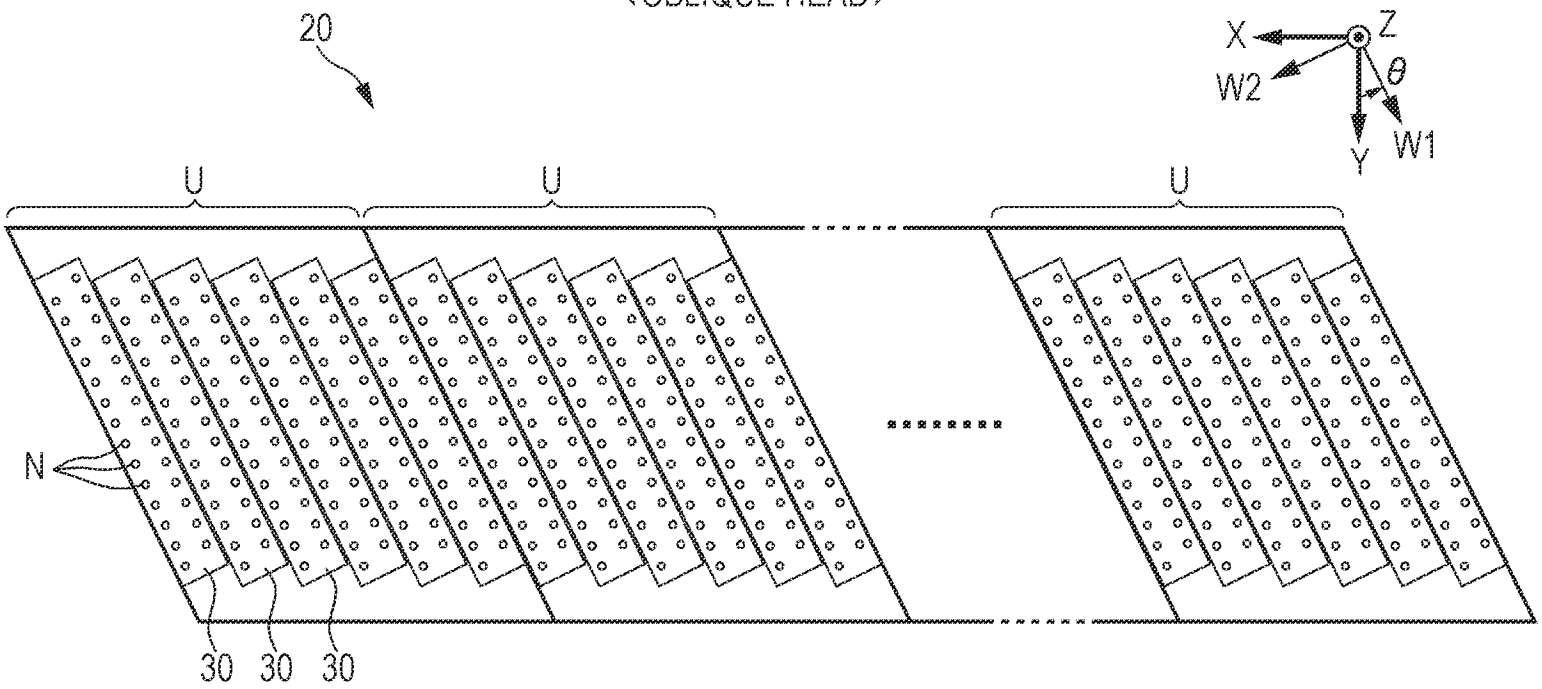
FIG. 2 is a plan view of a liquid ejecting module.

FIG. 2 is a plan view when the liquid ejecting module 20 is viewed from the printing medium P.

As illustrated in the figure, the liquid ejecting module 20 has a configuration in which a plurality of liquid ejecting units U as basics are arranged along the X direction.

The liquid ejecting unit U further includes a plurality of (six) liquid ejecting heads 30 which are arranged along the X direction. Though it will be described later, the liquid ejecting head 30 includes a plurality of nozzles N which are arranged in two columns which are inclined to the Y direction which is the transport direction of the printing medium P.

Figure 3:
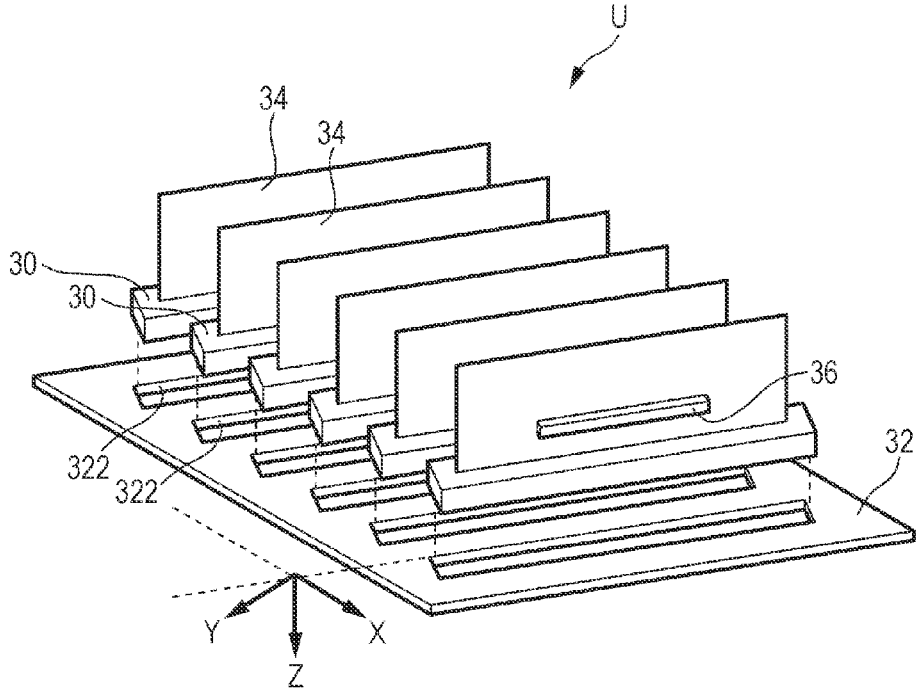
FIG. 3 is an exploded perspective view of a liquid ejecting unit.

FIG. 3 is an exploded perspective view for illustrating a configuration of one liquid ejecting unit U.

As illustrated in the figure, the six liquid ejecting heads 30 in the liquid ejecting module 20 are fixed to the surface of a flat-plate shaped fixing plate 32. An opening portion 322 for exposing the nozzle N of each of the liquid ejecting heads 30 is formed on the fixing plate 32.

One end of a wiring substrate 34 which is flexible, and on which a semiconductor chip 36 is mounted is connected to the liquid ejecting head 30. Though it is not illustrated in FIG. 3, the other end of the wiring substrate 34 is connected to the control unit 10. Though it will be described later in detail, in this manner, a configuration in which ejecting of ink using the liquid ejecting head 30 is controlled according to a control signal which is supplied from the control unit 10 is obtained.

Figure 4:
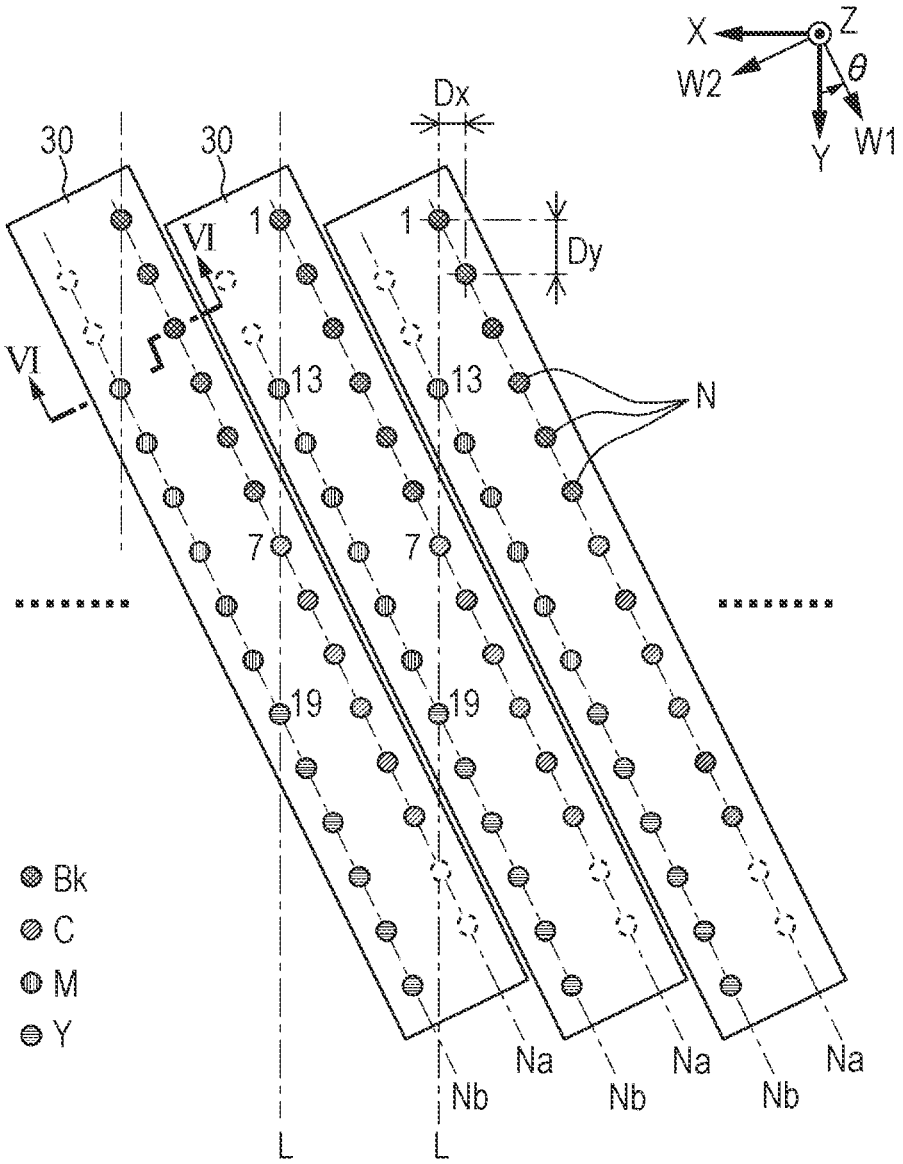
FIG. 4 is a diagram which illustrates an arrangement of nozzles in a liquid ejecting head.

FIG. 4 is a diagram which describes an arrangement of the nozzles N in the liquid ejecting module 20, and corresponds to a partially enlarged view of FIG. 2.

As described above, one liquid ejecting head 30 includes the plurality of nozzles N which are arranged in two columns; however, here, an arrangement of a single nozzle in the liquid ejecting head 30 in which inclination is not taken into consideration will be described first.

Figure 5:
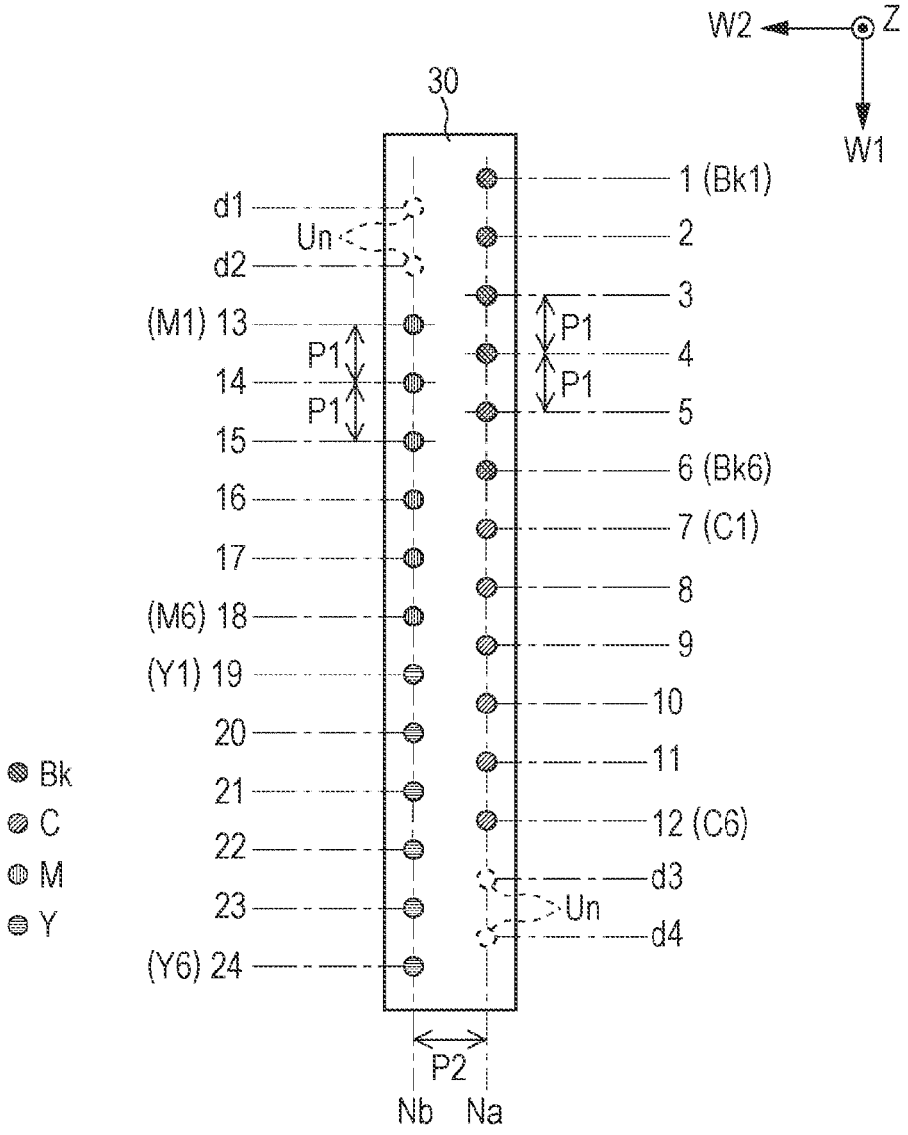
FIG. 5 is a diagram which illustrates an arrangement of the nozzles in the liquid ejecting head.

FIG. 5 is a diagram which illustrates an arrangement of the nozzles N in the liquid ejecting head 30. As illustrated in the figure, the nozzles N of the liquid ejecting head 30 are classified into a nozzle column Na (first group) and a nozzle column Nb (second group). In the nozzle columns Na and Nb, a respective plurality of nozzles N are arranged at an interval of a pitch P1 along a W1 direction (first direction), respectively. In addition, the nozzle columns Na and Nb are separated by a pitch P2 in a W2 direction which is orthogonal to the W1 direction. Nozzles N which belong to the nozzle column Na, and nozzles N which belong to the nozzle column Nb are in a relationship of being shifted by a half of the pitch P1 in the W1 direction.

Meanwhile, circles (marks Un) which are denoted by a broken line at an end portion on the positive side (lower end in figure) in the W1 direction in the nozzle column Na, and circles (similarly, marks Un) which are denoted by a broken line at an end portion on the negative side (higher end in figure) in the W1 direction in the nozzle column Nb are virtual lines which denote portions in which the nozzles N are blockaded in the non-ejecting unit which will be described later (or, portions which are not open). That is, the circles virtually denote positions of the nozzles N which may be provided as opening portions when they are not blockaded. In addition, the circles are referred to as virtual nozzles Un in a sense of virtual nozzles since the circles are not open; however, the circles are not classified as the nozzles N when considered as the nozzles arrangement.

In the invention, an image is formed when ink is ejected from the nozzle N; however, since printing data corresponding to the virtual nozzle Un is also supplied from the control unit 10, not only printing data corresponding to the nozzle N, it is a measure for classifying these data items.

In addition, in the specification, in order to describe the configuration in a simplified manner, the number of nozzles N in the nozzle columns Na and Nb is set to "twelve", respectively, and the number of virtual nozzles Un in the nozzle columns Na and Nb is set to "two", respectively.

In addition, in FIG. 5, hereinafter, nozzle numbers for specifying the nozzle N, or the like, are denoted. In the example, for the nozzle column Na, 1, 2, . . . , 11, and 12 are applied in order as the nozzle number from a nozzle N which is located at an end portion on the negative side in the W1 direction. For the nozzle column Nb, 13, 14, . . . , 23, and 24 are applied in order as serial numbers as nozzle numbers from a nozzle N which is located at an end portion on the negative side in the W1 direction.

In addition, for the virtual nozzles Un in the nozzle column Na, d3 and d4 are applied as nozzle numbers from the negative side in the W1 direction, and for the virtual nozzles Un in the nozzle column Nb, d1 and d2 are applied as nozzle numbers from the negative side in the W1 direction.

In FIG. 5, a correlation with a color of ink which is ejected from the nozzle N is also denoted. In the example, nozzles N of which nozzle numbers are "1" to "6" correspond to black (Bk), nozzles N of which nozzle numbers are "7" to "12" correspond to cyan (C), nozzles N of which nozzle numbers are "13" to "18" correspond to magenta (M), and nozzles N of which nozzle numbers are "19" to "24" correspond to yellow (Y).

As illustrated in FIG. 4, the liquid ejecting heads 30 which include the plurality of nozzles N are arranged by being inclined in the Y direction which is the transport direction of the printing medium P at an angle of θ. At this time, in the example in FIG. 4, in nozzles N which belong to the nozzle column Na, and nozzles N which belong to the nozzle column Nb, angles θ are set so that positions (coordinates) in the X direction are common.

Specifically, when focusing on one liquid ejecting head 30, in one nozzle N (nozzle N of which nozzle number is "1") which is located at an end portion on the negative side in the W1 direction in the nozzle column Na, and one nozzle N (nozzle N of which nozzle number is "13") which is located at the end portion on the negative side in the W1 direction in the nozzle column Nb, in the focused liquid ejecting head 30, angles θ are set so that the two nozzles pass through a virtual line L which extends in a direction parallel to the Y direction which is the transport direction of the printing medium P.

In addition, a liquid ejecting head 30 which is close to the focused liquid ejecting head 30 is in the following positional relationship with respect to the focused liquid ejecting head 30. That is, in a liquid ejecting head 30 which is close to the focused liquid ejecting head 30 on the left side in the figure, a nozzle N of which a nozzle number is "7", and a nozzle N of which a nozzle number is "19" are in a positional relationship of passing through the virtual line L.

For this reason, when a printing medium P is transported in the Y direction, it is possible to form a color dot in this manner by causing black (Bk) ink which is ejected from a nozzle N of which a nozzle number is "1", and magenta (M) ink which is ejected from a nozzle N of which a nozzle number is "13" in a certain liquid ejecting head 30, and cyan (C) ink which is ejected from a nozzle N of which a nozzle number is "7", and yellow (Y) ink which is ejected from a nozzle N of which a nozzle number is "19" in a liquid ejecting head 30 which is close to the liquid ejecting head 30 on the left side to land on the same positions.

In FIG. 4, nozzle numbers other than "1", "7", "13", and "19" are omitted; however, for example, nozzles N of which nozzle numbers are "2" and "14" in the focused liquid ejecting head, and nozzles N of which nozzle numbers are "8" and "20" in the liquid ejecting head 30 which is close to the focused liquid ejecting head 30 on the left side are located at the common position in the X direction. The same is applied to other nozzle numbers, though a correlation thereof is omitted.

Subsequently, a structure of the liquid ejecting head 30 will be described.

Figure 6:
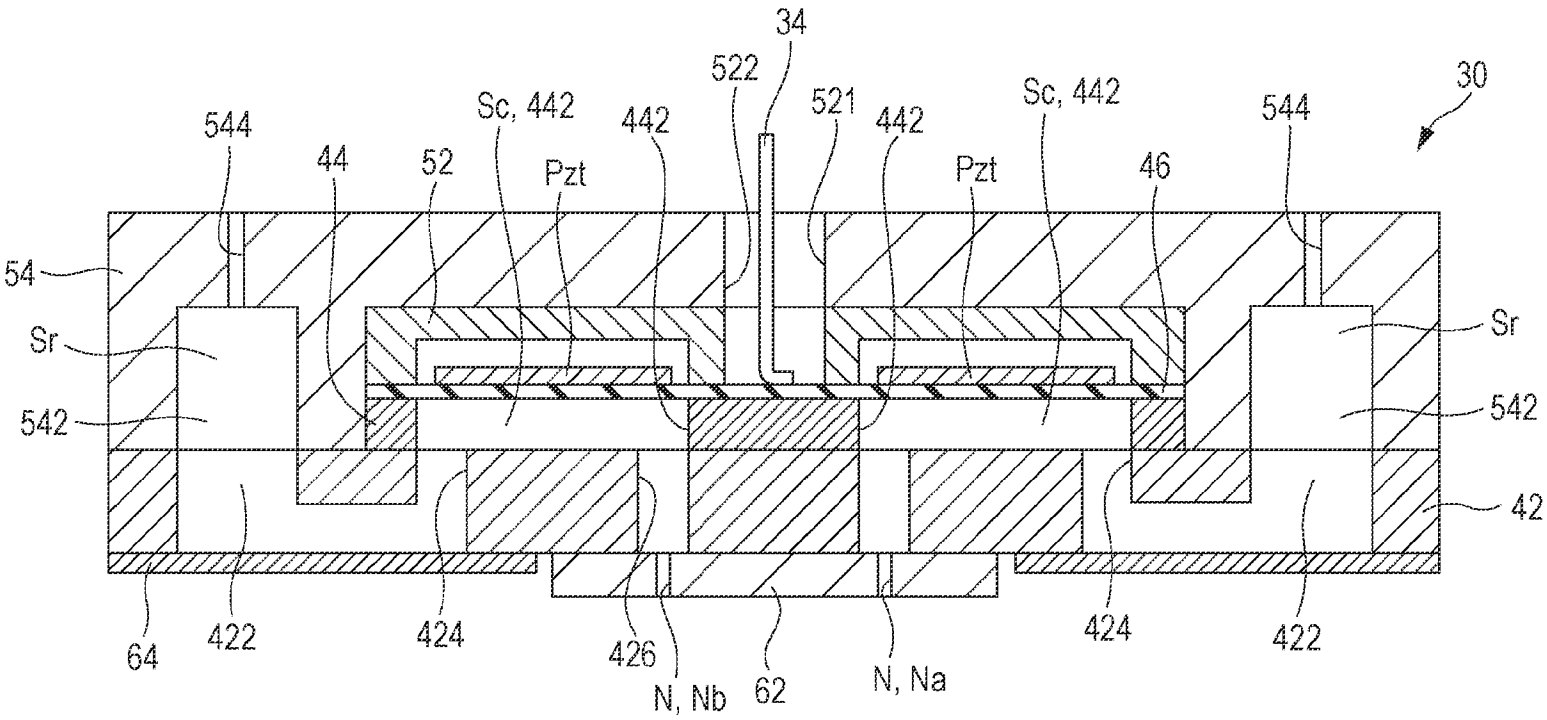
FIG. 6 is a sectional view of the liquid ejecting head.

FIG. 6 is a sectional view of one liquid ejecting head 30, and in detail, is a diagram which illustrates a section when being cut in line VI-VI (section which is orthogonal to W1 direction, and section when viewing negative direction from positive side in W1 direction) in FIG. 4.

As illustrated in FIG. 6, the liquid ejecting head 30 is a structure body (head chip) in which a pressure chamber substrate 44, a vibrating plate 46, a sealing body 52, and a support body 54 are provided on a plane on the negative side in the Z direction in a flow path substrate 42, and a nozzle plate 62 and a compliance unit 64 are provided on a plane on the positive side in the Z direction in the flow path substrate 42. Schematically, each element of the liquid ejecting head 30 is an approximately flat-plate shaped member which is long in the W1 direction as schematically described above, and is fixed to each other using an adhesive, for example. In addition, the flow path substrate 42 and the pressure chamber substrate 44 are formed using a silicon single-crystal substrate, for example.

The plurality of nozzles N are formed on the nozzle plate 62. As schematically described in FIG. 5, in the liquid ejecting head 30, a structure corresponding to the nozzle N which belongs to the nozzle column Na, and a structure corresponding to the nozzle N which belongs to the nozzle column Nb are in a relationship of being shifted by a half of a pitch P1 in the W1 direction; however, since the structures are formed approximately symmetrically other than that, hereinafter, the structure of the liquid ejecting head 30 will be described while focusing on the nozzle column Na.

The flow path substrate 42 is a flat-plate member which forms a flow path of ink, and on which an opening portion 422, a supply flow path 424, and a communication flow path 426 are formed. The supply flow path 424 and the communication flow path 426 are formed in each nozzle N, and the opening portion 422 is formed so as to be continued over the plurality of nozzles N which eject ink of the same color.

The support body 54 is fixed to the surface on the negative side in the Z direction of the flow path substrate 42. An accommodation unit 542 and an introducing flow path 544 are formed in the support body 54. The accommodation unit 542 is an external concave portion (hollow) corresponding to the opening portion 422 of the flow path substrate 42 when planarly viewed (that is, when viewed from Z direction), and the introducing flow path 544 is a flow path which communicates with the accommodation unit 542.

A space which causes the opening portion 422 of the flow path substrate 42 and the accommodation unit 542 of the support body 54 to communicate with each other functions as a liquid storage chamber (reservoir) Sr. The liquid storage chamber Sr is independently formed in each color of ink, and stores ink which passed through the liquid container 14 (refer to FIG. 1) and the introducing flow path 544. That is, four liquid storage chambers Sr corresponding to different ink are formed on the inside of one arbitrary liquid ejecting head 30.

An element which configures a base of the liquid storage chamber Sr, and suppresses (absorbs) a pressure change in ink in the liquid storage chamber Sr and the internal flow path is the compliance unit 64. The compliance unit 64 is configured by including a flexible member which is formed in a sheet shape, for example, and specifically, the compliance unit is fixed onto the surface of the flow path substrate 42 so that the opening portion 422 and each supply flow path 424 in the flow path substrate 42 are blocked.

The vibrating plate 46 is provided on the surface on the opposite side to the flow path substrate 42 of the pressure chamber substrate 44. The vibrating plate 46 is a flat-plate shaped member which can elastically vibrate, and is configured by stacking an elastic film which is formed of an elastic material such as silicon oxide, and an insulating film which is formed of an insulating material such as zirconium oxide, for example. The vibrating plate 46 and the flow path substrate 42 face each other with an interval in the inside of each opening portion 442 of the pressure chamber substrate 44. A space which is interposed between the flow path substrate 42 and the vibrating plate 46 in the inside of each opening portion 442 functions as the pressure chamber Sc which applies pressure to ink. Each pressure chamber Sc communicates with the nozzle N through each communication flow path 426 of the flow path substrate 42.

A plurality of piezoelectric elements Pzt which correspond to different nozzles N (pressure chamber Sc) are formed as driven elements on the surface on the opposite side to the pressure chamber substrate 44 of the vibrating plate 46 in each nozzle N.

Figure 7:
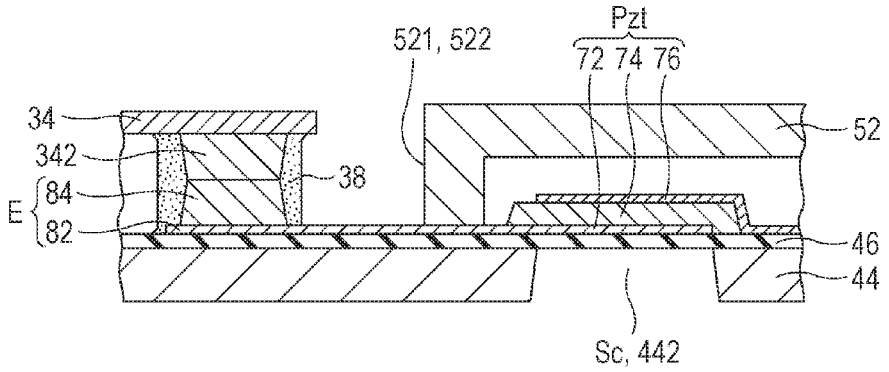
FIG. 7 is a partially enlarged view in the vicinity of a piezoelectric element in the liquid ejecting head.

FIG. 7 is a sectional view (section which is orthogonal to W1 direction) in which the vicinity of the piezoelectric element Pzt is enlarged. As illustrated in the figure, each of the piezoelectric elements Pzt includes a driving electrode 72 which is formed on a plane of the vibrating plate 46, a piezoelectric body 74 which is formed on a plane of the driving electrode 72, and a driving electrode 76 which is formed on a plane of the piezoelectric body 74. In addition, a region in which the driving electrodes 72 and 76 face each other by interposing the piezoelectric body 74 therebetween functions as the piezoelectric element Pzt.

As illustrated in the figure, an electrode E is formed on the surface of the vibrating plate 46, and is used when electrically connecting each wiring of the wiring substrate 34 and the piezoelectric element Pzt. The electrode E is configured by stacking connection wiring 82 and a connection terminal 84, and the connection wiring 82 is a conductive body (wiring) which is connected to the driving electrode 72 of the piezoelectric element Pzt. Here, a configuration in which the connection wiring 82 is caused to be continued on the same layer as the driving electrode 72 is exemplified; however, it may be a configuration in which the connection wiring 82 which is formed on a different layer from the driving electrode 72 is connected to the electrode E. The connection terminal 84 is a conductive body (crimped terminal) which is formed on the surface of the connection wiring 82 at an end portion on the opposite side to the piezoelectric element Pzt.

Figure 8:
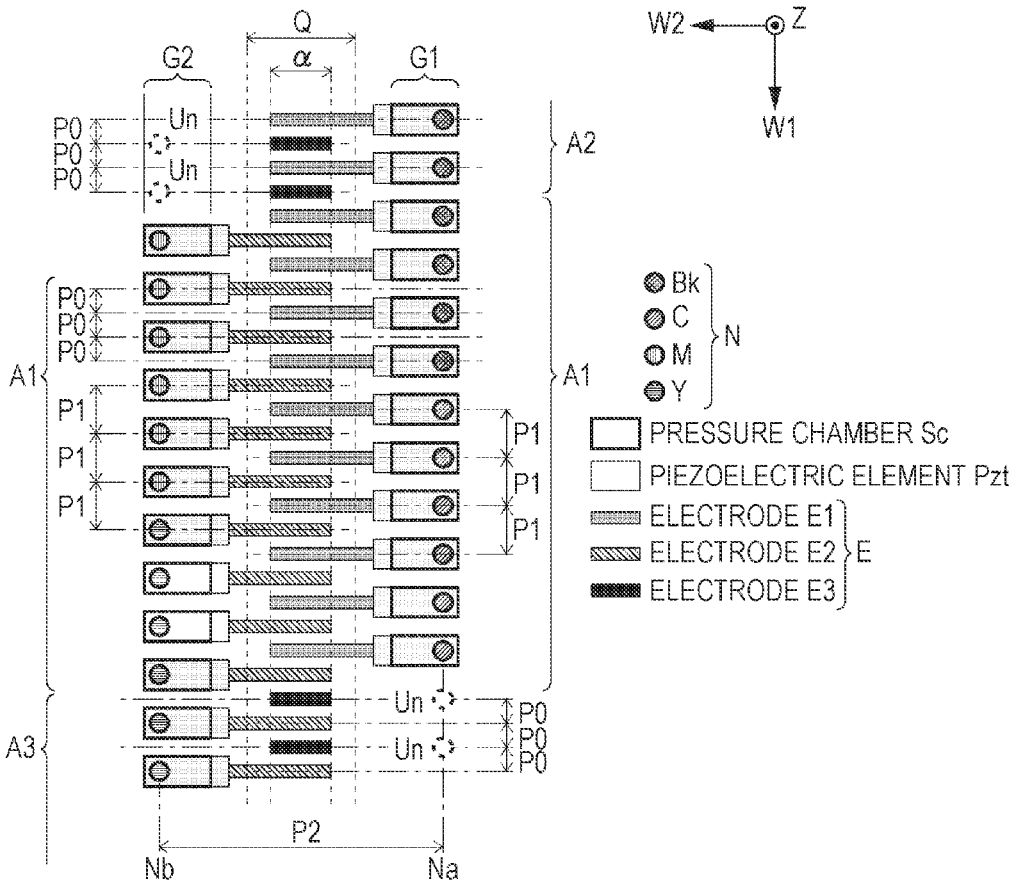
FIG. 8 is an explanatory diagram of a mounting region in the liquid ejecting head.

In addition, as illustrated in FIG. 8, each electrode E is formed (patterned) in a shape which extends in the W2 direction in a mounting region Q when planarly viewed.

The piezoelectric body 74 is formed using a process which includes a heating process (baking), for example. Specifically, the piezoelectric body 74 is formed by molding (for example, milling using plasma) a piezoelectric material which is applied onto the surface of the vibrating plate 46 on which the plurality of driving electrodes 72 are formed in each piezoelectric element Pzt, after baking the piezoelectric material using a heating process in a baking furnace. The driving electrode 72 is individually formed in each piezoelectric element Pzt.

The driving electrode 76 is commonly connected to wiring of a constant voltage (for example, voltage $V_{BS}$ which will be described later) which is individually formed in each of piezoelectric elements Pzt. In addition, the driving electrode 76 may have a configuration of being continued over the plurality of piezoelectric elements Pzt since the driving electrode is commonly connected.

FIG. 8 is a diagram which illustrates an arrangement of each element of the liquid ejecting head 30 when seeing through the element from the positive side (printing medium P side) in the Z direction.

As illustrated in the figure, the plurality of piezoelectric elements Pzt in the liquid ejecting head 30 are classified into element groups of G1 and G2. The element group G1 is a set of the piezoelectric elements Pzt which corresponds to the nozzles N of the nozzle column Na, and the element group G2 is a set of the piezoelectric elements Pzt which corresponds to the nozzles N of the nozzle column Nb. The piezoelectric elements Pzt which belong to the element group G1 are arranged along the W1 direction, and the piezoelectric elements Pzt which belong to the element group G2 are also similarly arranged along the W1 direction. The piezoelectric element Pzt in the element group G1, and the piezoelectric element Pzt in the element group G2 are alternately arranged by interposing the mounting region Q which is long in the W1 direction therebetween.

Meanwhile, in FIG. 6 or 7, the sealing body 52 is a structure body which protects the plurality of piezoelectric elements Pzt (for example, prevents adhering of moisture, or the like, with respect to piezoelectric element Pzt), reinforces mechanical intensity of the pressure chamber substrate 44 or the vibrating plate 46, and is fixed onto the surface of the vibrating plate 46 using an adhesive, for example. Each piezoelectric element Pzt is accommodated in a concave portion which is formed on the surface on the vibrating plate 46 side of the sealing body 52.

Here, the sealing body 52 includes wall faces 521 and 522. In the wall faces, the wall face 521 is located between the mounting region Q and the element group G1, the wall face 522 is located between mounting region Q and the element group G2, and a space to which the wiring substrate 34 is connected is secured between the element groups G1 and G2.

The space is denoted as the mounting region Q in FIG. 8.

As illustrated in FIG. 8, the mounting region Q is classified into regions A1, A2, and A3. The region A2 is located on the negative side in the W1 direction when viewed from the region A1, and the region A3 is located on the positive side in the W2 direction when viewed from the region A2. The region A1 corresponds to a region in which the element groups G1 and G2 (nozzle columns Na and Nb) are overlapped with each other along the W1 direction. The region A2 corresponds to a region which is not overlapped with the element group G2 in a range in the W1 direction in which the element group G1 is present, and the region A3 corresponds to a region which is not overlapped with the element group G1 in a range in the W1 direction in which the element group G2 is present.

As illustrated in FIG. 8, the plurality of electrodes E are also classified into electrodes E1, E2, and E3.

Each of the plurality of electrodes E1 is an electrode which is electrically connected to the piezoelectric element Pzt of the element group G1, respectively, which extends on the positive side in the W2 direction in the inside of the mounting region Q, and which is arranged in the W1 direction at the pitch P1 over the regions A1 and A2 in the mounting region Q.

Each of the plurality of electrodes E2 is an electrode which is electrically connected to the piezoelectric element Pzt of the element group G2, respectively, extends on the negative side in the W2 direction in the inside of the mounting region Q, and is arranged in the W1 direction at the pitch P1 which is the same as that of the electrode E1 over the regions A1 and A3 in the mounting region Q.

As illustrated in FIG. 8, in the region A1 of the mounting region Q, the electrodes E1 and E2 are alternately arranged along the W1 direction at a pitch P0 which is a half of the pitch P1. For this reason, a range in which the electrode E1 is present along the W2 direction, and a range in which the electrode E2 is present along the W2 direction are overlapped over a range α which goes along the W2 direction.

The electrode E3 is formed in each of regions A2 and A3; however, the electrode is not formed in the region A1. In addition, each of the electrodes E1 and E2 is electrically connected to the piezoelectric element Pzt, respectively, as described above; however, in contrast to this, in the example, the electrode E3 is not electrically connected to any of the piezoelectric elements Pzt. That is, the electrode E3 is a dummy electrode which does not contribute to an operation (ejecting of ink) of the piezoelectric element Pzt.

Each of the electrodes E3 is formed on the same layer (stacking of connection wiring 82 and connection terminal 84) as those of the electrodes E1 and E2.

The electrode E3 which is formed in the region A2 of the mounting region Q is located between two electrodes E1 which are close to each other at the pitch P1 along the W1 direction. That is, in the region A2, the electrodes E1 and E3 are alternately arranged along the W1 direction at the pitch P0.

Meanwhile, the electrode E3 which is formed in the region A3 of the mounting region Q is located between two electrodes E2 which are close to each other at the pitch P1 along the W1 direction. That is, in the region A3, the electrodes E2 and E3 are alternately arranged along the W1 direction at the pitch P0.

In this manner, the plurality of electrodes E are arranged at the equal pitch P0 along the W1 direction over the entire mounting region Q of regions A1, A2, and A3.

Though it will be described later in detail, a voltage Vout of a driving signal is applied to the driving electrode 72 through the wiring substrate 34, and a constant voltage $V_{BS}$ is applied to the driving electrode 76. In particular, as illustrated in FIG. 7, the piezoelectric element Pzt has a configuration in which the piezoelectric body 74 is interposed between the pair of driving electrodes 72 and 76, and in the piezoelectric element Pzt with such a configuration, in the driving electrodes 72 and 76, and the vibrating plate 46, center portions are bent toward the higher or lower direction with respect to both end portions at the periphery in FIG. 7 according to voltages which are applied in the driving electrodes 72 and 76. Specifically, the piezoelectric element Pzt has a configuration of being bent toward the higher direction when the voltage Vout of a driving signal which is applied through the driving electrode 72 becomes low, and a configuration of being bent to the lower direction when the voltage Vout becomes high, on the other hand.

Here, when the piezoelectric element is bent toward the higher direction, ink gets drawn from the liquid storage chamber Sr since an internal volume of the pressure chamber Sc increases, and on the other hand, when the piezoelectric element is bent toward the lower direction, the internal volume of the pressure chamber Sc decreases, and therefore, according to a degree of decrease, ink droplets are ejected from the nozzle N.

In this manner, when an appropriate driving signal is applied to the piezoelectric element Pzt, since ink droplets which fill the pressure chamber Sc are ejected from the nozzle N due to a displacement of the piezoelectric element Pzt, there is a case in which a configuration unit which includes the nozzle N, the piezoelectric element Pzt, and the pressure chamber Sc is referred to as an ejecting unit which ejects ink droplets.

Meanwhile, in the embodiment, each of the virtual nozzles Un has a configuration in which only the electrode E3 is provided corresponding to each of the virtual nozzles, and the nozzle N, the piezoelectric element Pzt, and the pressure chamber Sc are not provided. For this reason, even when the voltage Vout of the driving signal is applied through the electrode E3, an ejecting operation of ink droplets does not occur at all. For this reason, there is a case in which the virtual nozzle Un is referred to as the non-ejecting unit which does not eject ink droplets.

One end of the wiring substrate 34 is connected to the mounting region Q. In detail, the connection terminals 342 (wiring) which correspond to each of the electrodes E (electrodes E1, E2, and E3) are formed at one end of the wiring substrate 34, and the wiring substrate 34 is fixed onto the surface of the vibrating plate 46 using an adhesive 38 in a state in which these connection terminals 342 come into contact with each electrode E (connection terminal 84) on the surface of the vibrating plate 46.

As a fixing method, for example, the fluid-type adhesive 38 is applied inside the mounting region Q (range α), and the wiring substrate 34 is fixed to the liquid ejecting head 30 when the adhesive 38 is cured in a state in which one end of the wiring substrate 34 is pressed on the surface of the vibrating plate 46.

Here, a configuration in which the electrode E3 is not provided in the regions A2 and A3 will be assumed as a comparison example of the embodiment. That is, the comparison example has a configuration in which the electrodes E1 and E2 are alternately arranged at the pitch P0 in the region A1 along the W1 direction; however, only the electrode E1 is arranged at the pitch p1 in the region A2, and only the electrode E2 is arranged at the pitch P1 in the region A3. Accordingly, in the comparison example, density of the electrode E in the regions A2 and A3 is lower than a density of the electrode E in the region A1. In such a comparison example, in the region A1, the adhesive 38 which is applied on the surface of the vibrating plate 46 in order to fix the wiring substrate 34 is distributed in a narrow space between the electrodes E1 and E2 which are neighboring each other at the pitch P0, and in contrast to this, in the region A2, the adhesive can be distributed in a wide space between the electrodes E1 which are neighboring each other at the pitch P1. For this reason, when an application amount with which the adhesive 38 is optimally distributed in the region A1 is selected, the adhesive 38 is insufficient in the region A2, and as a result, it is difficult to sufficiently secure adhesive strength of the wiring substrate 34. On the other hand, when an application amount with which the adhesive 38 is optimally distributed in the region A2 is selected, there is a problem of a surplus of the adhesive 38 in the region A1. For example, when the adhesive 38 is excessive in the region A1, the adhesive 38 of the region A1 reaches the sealing body 52 by flowing in a wide range in a process of pressing the wiring substrate 34 with respect to the vibrating plate 46, and there is a problem in that a position of the wiring substrate 34 is shifted due to stress from the adhesive 38 which is dammed in the wall faces 521 and 522. In addition, here, the regions A1 and A2 are focused for convenience; however, the same problem can occur in the region A3, as well.

In contrast to this, in the embodiment, the electrodes E1 and E2 are alternately arranged at the pitch P0 in the region A1, and meanwhile, the electrode E3 is formed between two electrodes E1 which are neighboring each other in the region A2, and the electrode E3 is formed between two electrodes E2 which are neighboring each other in the region A3. For this reason, according to the embodiment, a difference in coarseness and fineness of the electrode E (difference between A1 and A2, or difference between A1 and A3) in the mounting region Q is suppressed when compared with the comparison example.

Therefore, according to the embodiment, there is an advantage that it is possible to solve a problem of the comparison example (insufficient adhesive strength, or position error of wiring substrate 34) which is caused by a difference in coarseness and fineness of the electrode E in the mounting region Q.

Subsequently, an electrical configuration of the printing apparatus 1 will be described.

Figure 9:
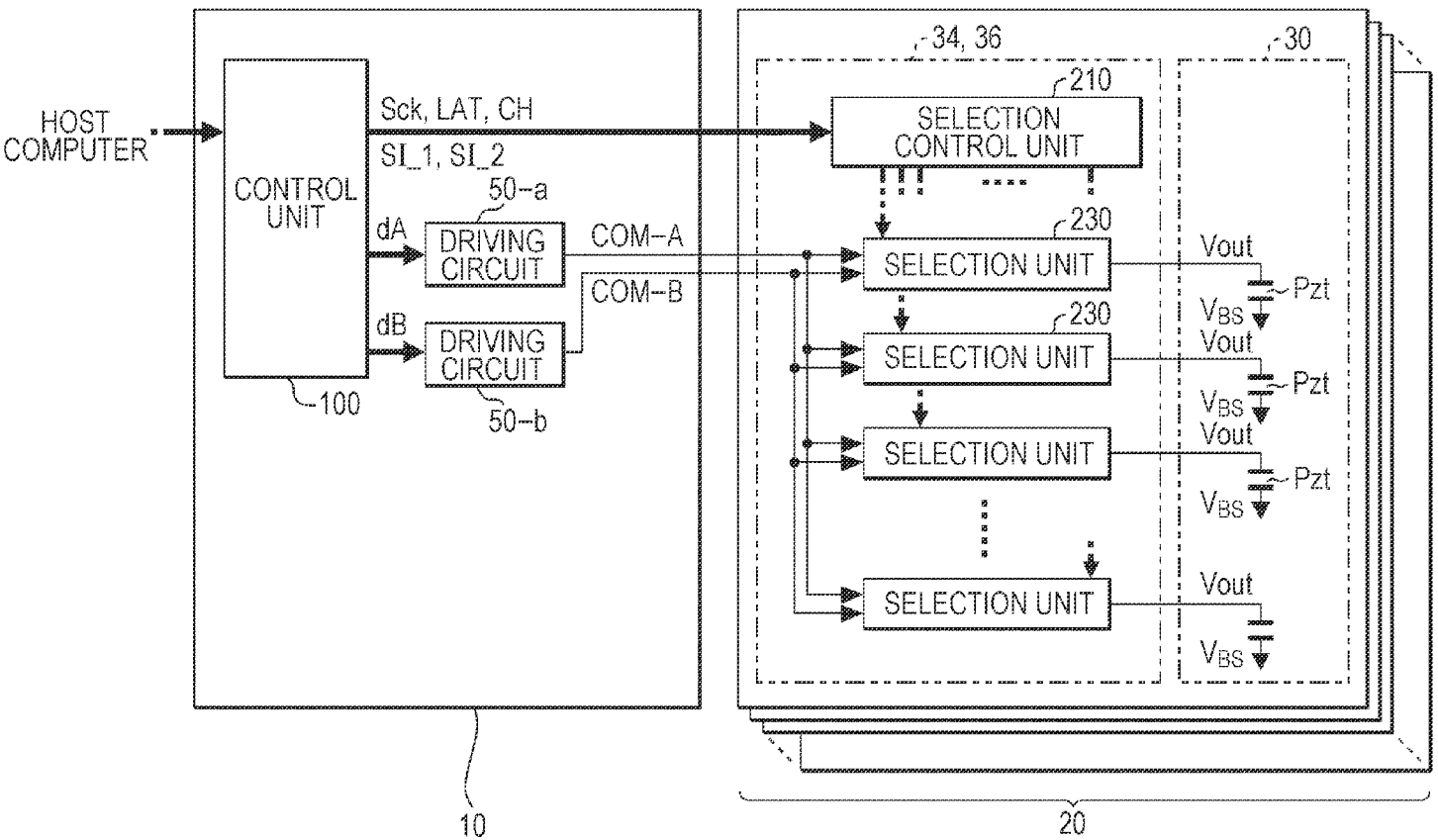
FIG. 9 is a block diagram which illustrates a functional configuration of a printing apparatus.

FIG. 9 is a block diagram which illustrates the electrical configuration of the printing apparatus 1.

As illustrated in the figure, the printing apparatus 1 has a configuration in which the liquid ejecting module 20 is connected to the control unit 10.

As described above, the liquid ejecting module 20 is configured of a plurality of liquid ejecting units U, and the liquid ejecting unit U includes a plurality of (six) the liquid ejecting heads 30. Here, when setting the number of liquid ejecting units U to U as an integer, the number of liquid ejecting heads 30 becomes 6×U.

The control unit 10 independently controls the 6×U liquid ejecting heads 30, respectively; however, here, a control of one liquid ejecting head 30 will be representatively described for convenience.

As illustrated in FIG. 9, the control unit 10 includes a control section 100, and driving circuits 50-*a* and 50-*b*.

The control section 100 is a type of a microcomputer which includes a CPU, a RAM, a ROM, and the like, and has a function of outputting various control signals for controlling each unit when image data is supplied from a host computer by executing a predetermined program.

Specifically, first, the control section 100 repeatedly supplies digital data dA to one driving circuit 50-*a* in the driving circuits 50-*a* and 50-*b*, and repeatedly supplies digital data dB to the other driving circuit 50-*b*, similarly. Here, the data dA defines a waveform of a driving signal COM-A in the driving signals which are supplied to the liquid ejecting head 30, and the data dB defines a waveform of a driving signal COM-B.

In addition, the driving circuit 50-*a* converts the data dA into analog data, performs class-D amplification, for example, and then supplies the amplified signal to the liquid ejecting head 30 as the driving signal COM-A. Similarly, the driving circuit 50-*b* converts the data dB into analog data, performs class-D amplification, for example, and then supplies the amplified signal to the liquid ejecting head 30 as the driving signal COM-B.

In addition, in the driving circuits 50-*a* and 50-*b*, only input data and a driving signal to be output are different, circuit configurations are the same.

Secondly, the control section 100 supplies a clock signal Sck, control signals LAT and CH, and printing data SI_1 and SI_2 to the liquid ejecting head 30.

In addition to that, the control section 100 controls a transportation of the printing medium P in the Y direction by controlling the transport mechanism 12; however, the configuration for that will be omitted.

The semiconductor chip 36 which is mounted on the wiring substrate 34 includes a selection control unit 210 (distribution unit), and a plurality of selection units 230 which form a pair (set) with nozzles. Here, the nozzle means both the nozzle N in the ejecting unit and the virtual nozzle Un in the non-ejecting unit.

Meanwhile, the liquid ejecting head 30 is configured of a plurality of the piezoelectric elements Pzt (in example in FIG. 8, 12×2 columns=24) in an electrical view.

Though it will be described in detail later, the selection control unit 210 distributes printing data which is supplied from the control section 100 by being multiplexed in serial by corresponding to each of the ejecting unit and the non-ejecting unit, and meanwhile, the selection unit 230 selects the driving signals COM-A and COM-B (or, does not select both) according to the distributed printing data, and applies the signals to an electrode 72 (E1 or E2) which is one end of the piezoelectric element Pzt when it is the ejecting unit, and to an electrode 72 (E3) when it is the non-ejecting unit as driving signals (signal waveforms), respectively.

In addition, in FIG. 9, a configuration corresponding to the non-ejecting unit of the liquid ejecting head 30 is omitted. In addition, in the figure, a voltage of the driving signal which is selected in the selection unit 230 is denoted by Vout in order to classify the signals into driving signals COM-A and COM-B.

In the example, the voltage $V_{BS}$ is commonly applied to the other end of each of the piezoelectric elements Pzt, as described above.

According to the embodiment, for one dot, four grayscales of a large dot, a middle dot, a small dot, and non-recording are expressed by ejecting ink two times at maximum from one nozzle N. In order to express the four grayscales, according to the embodiment, the driving signals COM-A and COM-B of two types are prepared, and the first half pattern and the second half pattern are given, respectively, in each one cycle. In addition, it is a configuration in which the driving signals COM-A and COM-B are selected (or not selected) according to grayscales to be expressed in the first half and the second half in one cycle, and are distributed to the piezoelectric element Pzt.

Therefore, the driving signals COM-A and COM-B will be described first, and then a configuration for distributing the driving signals COM-A and COM-B will be described.

Figure 10:
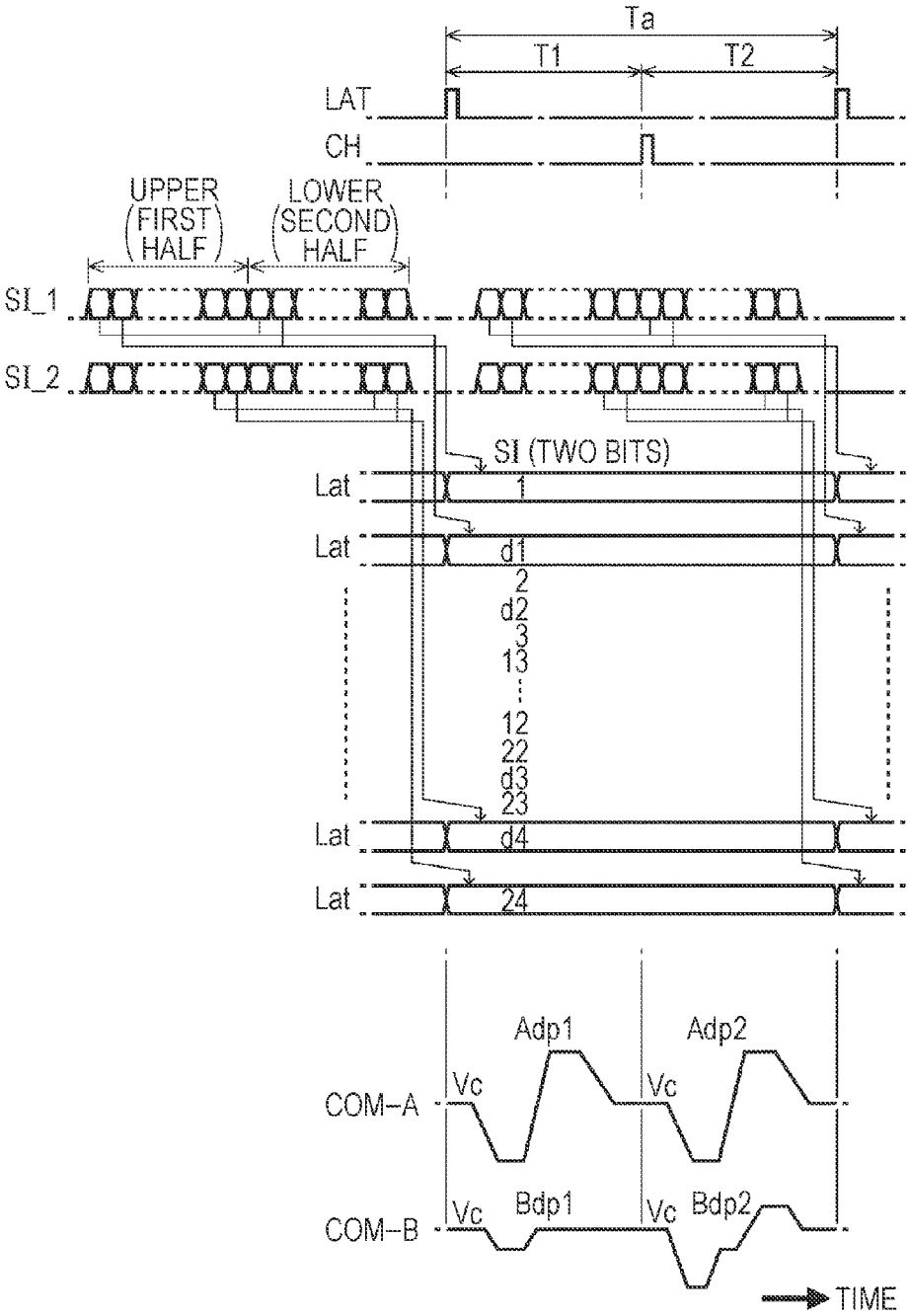
FIG. 10 is a diagram which describes an operation of a selection control unit.

FIG. 10 is a diagram which illustrates waveforms, or the like, of the driving signals COM-A and COM-B.

As illustrated in the figure, the driving signal COM-A is formed in a waveform in which a trapezoidal waveform Adp1 which is arranged at a period T1 from outputting (rising) of a control signal LAT to outputting of a control signal CH in a printing period Ta, and a trapezoidal waveform Adp2 which is arranged at a period T2 from outputting of the control signal CH to outputting of the subsequent control signal LAT in the printing period Ta are to be continued.

According to the embodiment, the trapezoidal waveforms Adp1 and Adp2 have approximately the same waveform as each other, and are waveforms which causes ink of a predetermined amount, specifically, ink of a medium amount to be ejected from a nozzle N which corresponds to a piezoelectric element Pzt, when it is assumed that the respective trapezoidal waveforms are supplied to one end of the piezoelectric element Pzt.

The driving signal COM-B has a waveform in which a trapezoidal waveform Bdp1 which is arranged at a period T1, and a trapezoidal waveform Bdp2 which is arranged at a period T2 are to be continued. According to the embodiment, the trapezoidal waveforms Bdp1 and Bdp2 have a different waveform from each other. In the waveforms, the trapezoidal waveform Bdp1 is a waveform for preventing an increase in viscosity of ink by causing ink in the vicinity of the nozzle N to minutely vibrate. For this reason, ink droplets are not ejected from a nozzle N corresponding to a piezoelectric element Pzt even when it is assumed that the trapezoidal waveform Bdp1 is supplied to one end of the piezoelectric element Pzt. In addition, the trapezoidal waveform Bdp2 has a waveform which is different from that of the trapezoidal waveform Adp1 (Adp2). When it is assumed that the trapezoidal waveform Bdp2 is supplied to one end of the piezoelectric element Pzt, it is a waveform which causes ink of a smaller amount than the predetermined amount is to be ejected from the nozzle N which corresponds to the piezoelectric element Pzt.

In addition, both a start timing of the trapezoidal waveforms Adp1, Adp2, Bdp1, and Bdp2 and an end timing thereof are common in a voltage Vc. That is, the trapezoidal waveforms Adp1, Adp2, Bdp1, and Bdp2 are waveforms which start in the voltage Vc, respectively, and end in the voltage Vc.

Figure 12:
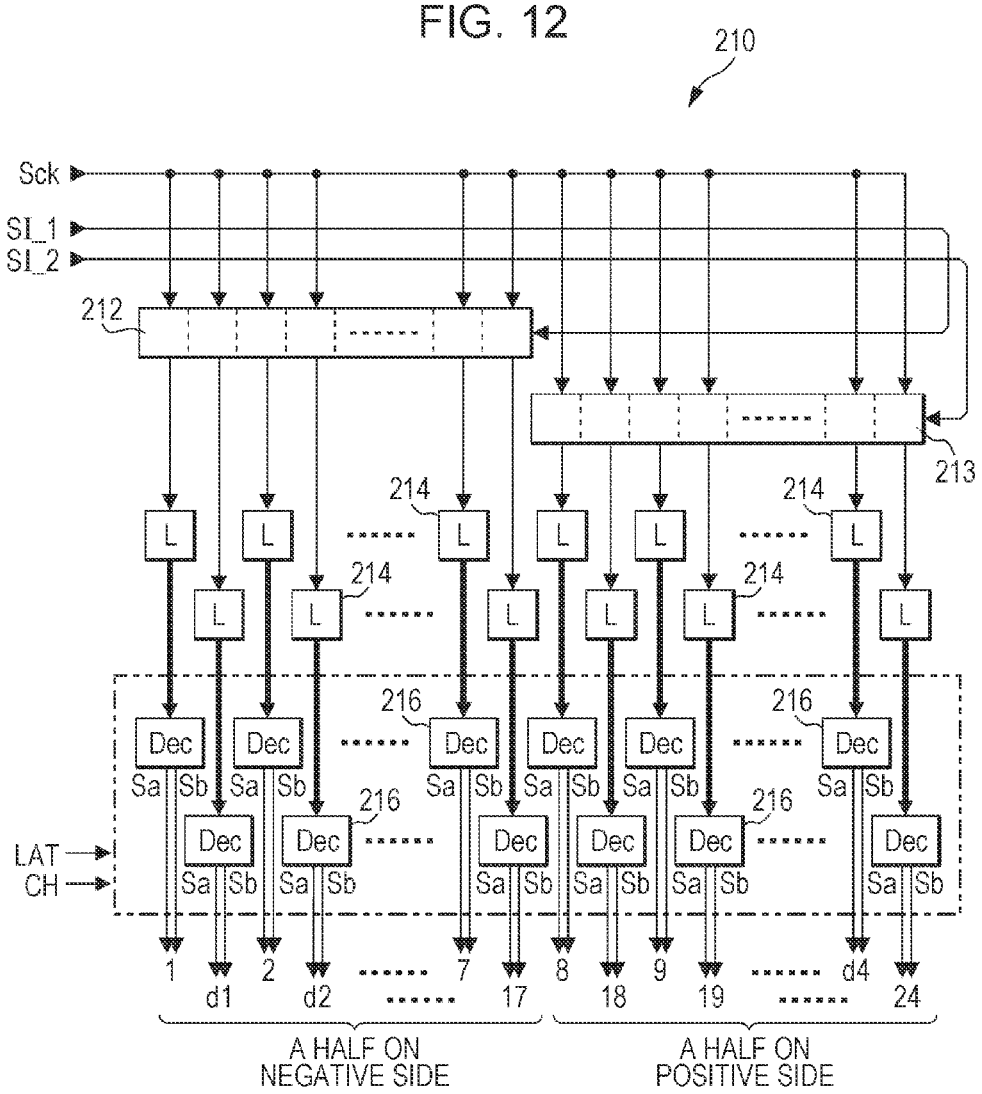
FIG. 12 is a diagram which illustrates a configuration of the selection control unit.

FIG. 12 is a diagram which illustrates a configuration of the selection control unit 210 in FIG. 10.

As illustrated in the figure, in the selection control unit 210, the clock signal Sck, the control signals LAT and CH, and printing data SI_1 and SI_2 are supplied from the control unit 10. In the selection control unit 210, a set of a latch circuit 214 and a decoder 216 is provided corresponding to each of the nozzle N and the virtual nozzle Un, in addition to shift registers 212 and 213.

According to the embodiment, since one dot of an image which is formed on the printing medium P is expressed using four grayscales, as described above, the printing data SI which defies the one dot is configured of 2 bits of an upper bit and a lower bit. The printing data SI is divided into two systems of printing data SI_1 and SI_2, and is supplied as follows in the embodiment.

Figure 11:
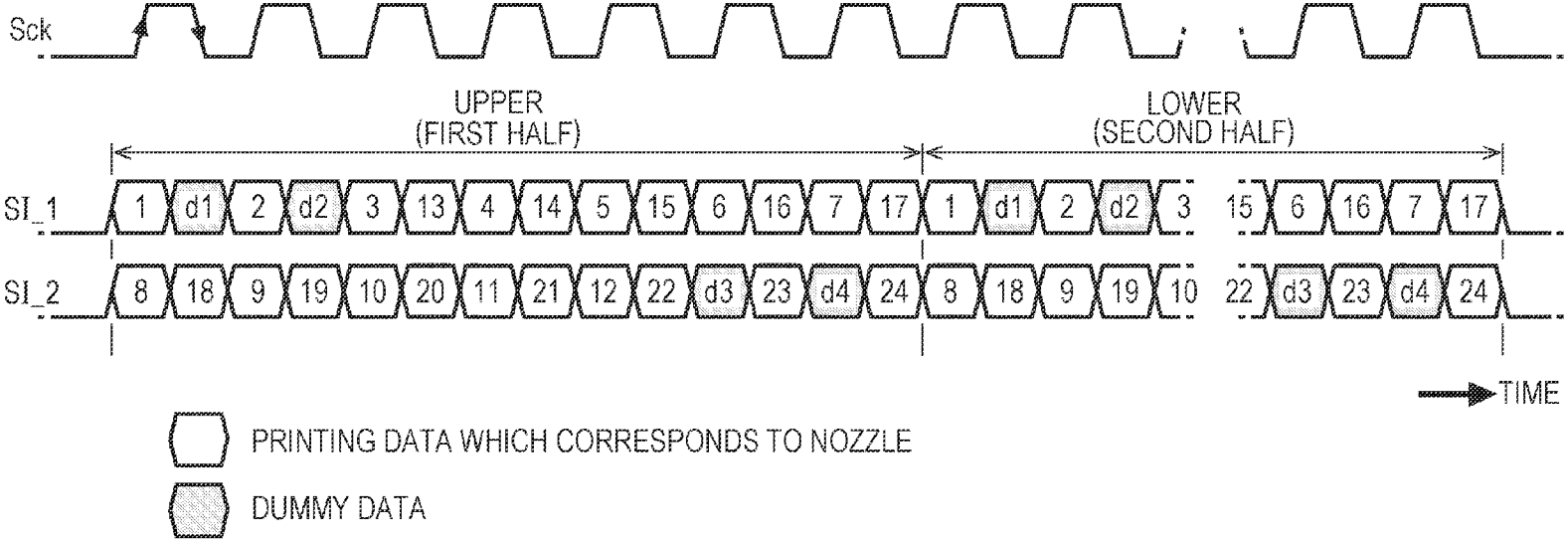
FIG. 11 is a diagram which illustrates order of printing data which is supplied from a control unit.

FIG. 11 is a diagram which denotes that to which nozzle N and virtual nozzle Un the printing data SI_1 and SI_2 which are supplied to one certain liquid ejecting head 30 correspond using a nozzle number in the liquid ejecting head 30.

As illustrated in the figure, the printing data SI_1 corresponds to a half (a half on negative side) of the nozzle N and virtual nozzle Un in the liquid ejecting head 30 which are located on the negative side in the W1 direction, and is alternately supplied in the nozzle columns Na and Nb. In detail, the printing data SI_1 is supplied in order of nozzle numbers of "1", "d1", "2", "d2", . . . , "6", "16", "7", and "17" in each of the first half and the second half, defines the upper bit in the first half, and defines the lower bit in the second half.

In addition, the printing data SI_2 corresponds to a half (a half on positive side) of the nozzle N and virtual nozzle Un in the liquid ejecting head 30 which are located on the positive side in the W1 direction, and is alternately supplied in the nozzle columns Na and Nb. In detail, the printing data SI_2 is supplied in order of nozzle numbers of "8", "18", "9", "19", . . . , "d3", "23", "d4", and "24" in each of the first half and the second half, defines the upper bit in the first half, and defines the lower bit in the second half.

In addition, according to the embodiment, in the printing data which corresponds to the nozzle N, image data which is supplied from the host computer is subjected to a process such as a rotation, or the like, according to a nozzle arrangement, or the like. Meanwhile, in the printing data with respect to the nozzle numbers "d1" to "d4" which correspond to the virtual nozzle Un, a dummy signal of "0" (L) is set to both the upper bit and the lower bit.

In this manner, according to the embodiment, the printing data SI which corresponds to the nozzle N and the virtual nozzle Un is divided into the printing data SI_1 which is a half on the negative side, and the printing data SI_2 which is a half on the positive side, is multiplexed on a common flow path, respectively, and is supplied from the control unit 10 (control section 100).

In addition, as follows, it has a configuration in which the driving signals COM-A and COM-B are selected (or, are not selected) according to the printing data, and are applied to any one of the electrodes E1, E2, and E3 as the voltage Vout of the driving signal.

When returning to FIG. 12, the shift register 212 includes the number of stages which corresponds to each of the nozzle N and the virtual nozzle Un of a half on the negative side, and sequentially transmits the printing data SI_1 from a stage on the right end to a stage on the left end in the figure, using rising and falling in the clock signal Sck in each of the first half and the second half.

In the shift register 212, when the first half ends, since the upper bits of printing data which corresponds to nozzle numbers of "1", "d1", "2", "d2", . . . , "6", "16", "7", and "17" are stored from a stage on the left end in order in the figure, these are supplied to the latch circuit 214, respectively, and when the second half ends, since lower bits of printing data are stored, these are supplied to the latch circuit 214, respectively.

The shift register 213 includes the number of stages which respectively corresponds to the nozzle N and the virtual nozzle Un of a half on the positive side, and sequentially transmits the printing data SI_2 from a stage on the right end to a stage on the left end in the figure, using rising and falling in the clock signal Sck in each of the first half and the second half.

In the shift register 212, when the first half ends, since upper bits of printing data which corresponds to nozzle numbers of "8", "18", "9", "19", . . . , "d3", "23", "d4", and "24" are stored from a stage on the left end in order in the figure, these are supplied to the latch circuit 214, respectively, and when the second half ends, since lower bits of printing data are stored, these are supplied to the latch circuit 214, respectively.

Each of the latch circuits (Lat) 214 holds two bits of the upper bits which are supplied when the first half ends, and the lower bits which are supplied when the second half ends over the period Ta. That is, the multiplexed printing data SI (SI_1 and SI_2) are held by being distributed to the latch circuit 214 which corresponds to each of the ejecting unit and the non-ejecting unit.

Each of the decoders (Dec) 216 decodes the printing data SI of 2 bits which is held by the latch circuit 214, and outputs selection signals Sa and Sb in each of periods T1 and T2 which is defined using the control signal LAT and the control signal CH, and a selection in the selection unit 230 is designated.

Figures 13, 14:
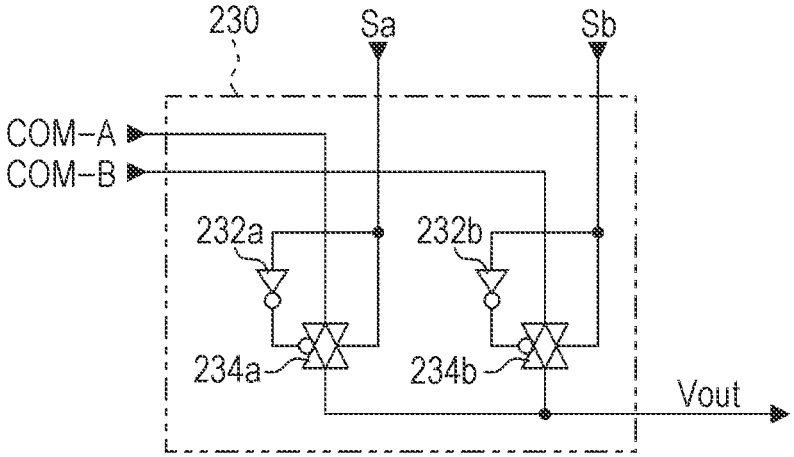
FIG. 13 is a diagram which illustrates decoding contents in a decoder.
FIG. 14 is a diagram which illustrates a configuration of a selection unit.

FIG. 13 is a diagram which illustrates decoding contents in the decoder 216.

In the figure, the printing data SI of two bits which is held by the latch circuit 214 is denoted by (Upper, Lower). In the decoder 216, it means that when the latched printing data SI is (0, 1), logic levels of the selection signals Sa and Sb are output by being set to an H level and an L level in the period T1, respectively, and by being set to an L level and an H level in the period T2, respectively.

In addition, the logic levels of the selection signals Sa and Sb are subjected to a level shift of high-amplitude logic using a level shifter (not illustrated), compared to logic levels of the clock signal Sck, the printing data SI, the control signals LAT and CH.

FIG. 14 is a diagram which illustrates a configuration of the selection unit 230 in FIG. 9.

As illustrated in the figure, the selection unit 230 includes inverters (NOT circuit) 232*a* and 232*b*, and transfer gates 234*a* and 234*b*.

The selection signal Sa from the decoder 216 is supplied to a positive control end to which a circle is not attached in the transfer gate 234*a*, and meanwhile, the selection signal is supplied to a negative control end to which a circle is attached in the transfer gate 234*a* by being subjected to logic reversing using the inverter 232*a*. Similarly, the selection signal Sb is supplied to a positive control end of the transfer gate 234*b*, and meanwhile, the selection signal is supplied to a negative control end of the transfer gate 234*b* by being subjected to logic reversing using the inverter 232*b*.

The driving signal COM-A is supplied to an input end of the transfer gate 234*a*, and the driving signal COM-B is supplied to an input end of the transfer gate 234*b*. Output ends of the transfer gates 234*a* and 234*b* are commonly connected, and are connected to one end of a corresponding piezoelectric element Pzt.

The transfer gate 234*a* causes an input end and an output end to be electrically connected (ON) therebetween when the selection signal Sa is an H level, and causes the input end and the output end not to be electrically connected (OFF) therebetween when the selection signal Sa is an L level. Similarly, in the transfer gate 234*b*, an input end and an output end are subjected to ON-OFF therebetween according to the selection signal Sb.

Subsequently, operations of the selection control unit 210 and the selection unit 230 will be described with reference to FIG. 10.

As described above, each of the latch circuits 214 holds 2 bits of the upper bit which is supplied when the first half ends, and the lower bit which is supplied when the second half ends over the period Ta. For this reason, as illustrated in FIG. 10, each of the latch circuits 214 supplies 2 bits of the printing data SI of a corresponding nozzle number to the decoder 216 in the period Ta.

The decoder 216 outputs logic levels of the selection signals Sa and Sb using contents which are illustrated in FIG. 13 in the respective periods T1 and T2, according to the printing data signal SI which is latched.

That is, first, the decoder 216 sets the selection signals Sa and Sb to an H level and an L level in the period T1, and to the H level and the L level in the period T2, as well, when the printing data SI is (1, 1), and defines a size of a large dot. Secondly, the decoder 216 sets the selection signals Sa and Sb to an H level and an L level in the period T1, and to the L level and the H level in the period T2 when the printing data SI is (0, 1), and defines a size of a middle dot. Thirdly, the decoder 216 sets the selection signals Sa and Sb to the L level and the L level in the period T1, and to the L level and the H level in the period T2 when the printing data SI is (1, 0), and defines a size of a small dot. Fourthly, the decoder 216 sets the selection signals Sa and Sb to the L level and the H level in the period T1, and to the L level and the L level in the period T2 when the printing data SI is (0, 0), and defines non-recording.

Figure 15:
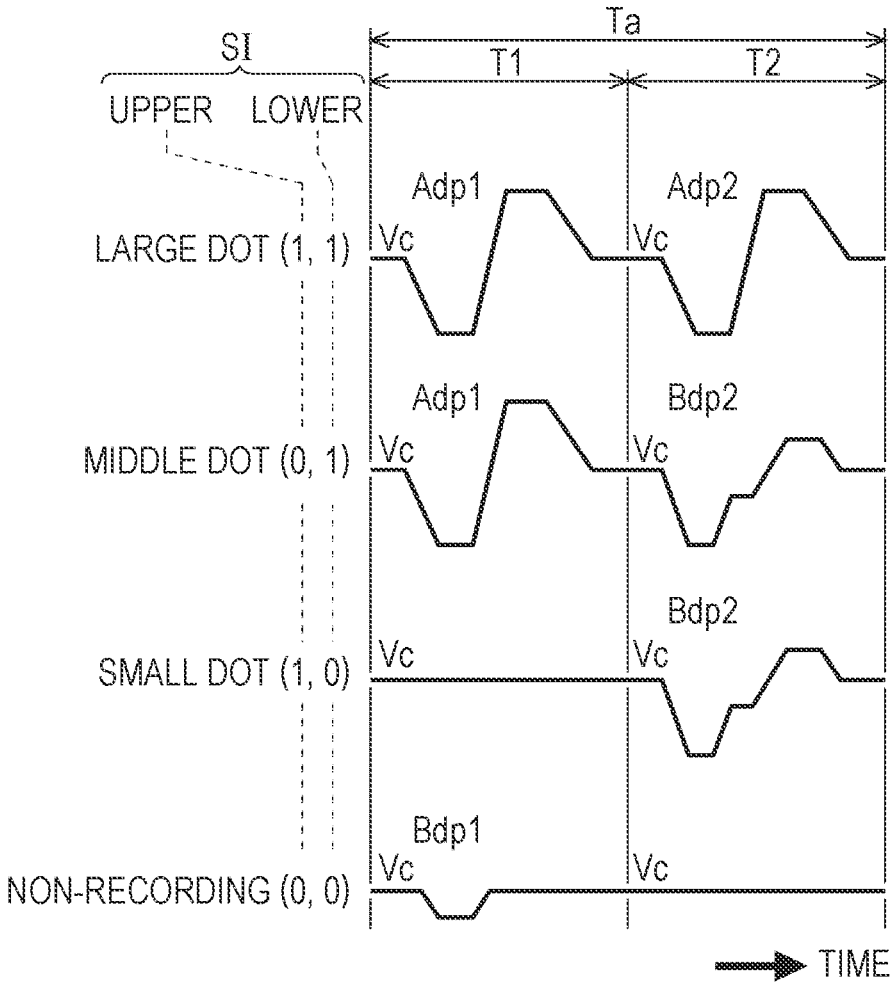
FIG. 15 is a diagram which illustrates a driving signal which is supplied to a piezoelectric element by being selected by the selection unit.

FIG. 15 is a diagram which illustrates a voltage waveform of a driving signal which is selected according to the printing data SI, and is supplied to one end of the piezoelectric element Pzt.

When the printing data SI is (1, 1), since the selection signals Sa and Sb are set to the H level and the L level in the period T1, the transfer gate 234*a* is turned on, and the transfer gate 234*b* is turned off. For this reason, the trapezoidal waveform Adp1 of the driving signal COM-A is selected in the period T1. Since the selection signals Sa and Sb are set to the H level and the L level in the period T2, as well, the selection unit 230 selects the trapezoidal waveform Adp2 of the driving signal COM-A.

In this manner, when the trapezoidal waveform Adp1 is selected in the period T1, the trapezoidal waveform Adp2 is selected in the period T2, and the trapezoidal waveforms are supplied to one end of the piezoelectric element Pzt as driving signals, ink of a medium amount is ejected from a nozzle N which corresponds to the piezoelectric element Pzt by divided into two times. For this reason, respective inks land onto the printing medium P, and are united, and as a result, a large dot which is defined by the printing data SI is formed on the printing medium P.

When the printing data SI is (0, 1), since the selection signals Sa and Sb are set to an H level and an L level in the period T1, the transfer gate 234*a* is turned on, and the transfer gate 234*b* is turned off. For this reason, the trapezoidal waveform Adp1 of the driving signal COM-A is selected in the period T1. Subsequently, since the selection signals Sa and Sb are set to the L level and the H L level in the period T2, the trapezoidal waveform Bdp2 of the driving signal COM-B is selected.

Accordingly, ink of a medium amount and a small amount are ejected from the nozzle by being divided into two times. For this reason, respective inks are landed onto the printing medium P, and are united, and as a result, a medium dot which is defined by the printing data SI is formed on the printing medium P.

When the printing data SI is (1, 0), since both the selection signals Sa and Sb are set to the L level in the period T1, the transfer gates 234*a* and 234*b* are turned off. For this reason, neither the trapezoidal waveform Adp1 nor the trapezoidal waveform Bdp1 is selected in the period T1. When both the transfer gates 234*a* and 234*b* are turned off, a flow path from a connection point of the output ends of the transfer gates 234*a* and 234*b* to one end of the piezoelectric element Pzt enters a state of high impedance of not being electrically connected to any portion. However, the piezoelectric element Pzt holds a voltage ($Vc-V_{BS}$) which is a voltage just before the transfer gate is turned off due to own capacitive property.

Subsequently, since the selection signals Sa and Sb are set to an L level and an H level in the period T2, the trapezoidal waveform Bdp2 of the driving signal COM-B is selected. For this reason, since ink of a small amount is ejected from the nozzle N only in the period T2, a small dot which is defined by the printing data SI is formed on the printing medium P.

When the printing data SI is (0, 0), since the selection signals Sa and Sb are set to an L level and an H level in the period T1, the transfer gate 234*a* is turned off, and the transfer gate 234*b* is turned on. For this reason, the trapezoidal waveform Bdp1 of the driving signal COM-B is selected in the period T1. Subsequently, since both the selection signals Sa and Sb are set to the L level in the period T2, neither the trapezoidal waveform Adp2 nor the trapezoidal waveform Bdp2 is selected.

For this reason, since ink in the vicinity of the nozzle N merely vibrates minutely, and is not ejected in the period T1, as a result, a dot is not formed. That is, it enters a non-recording state which is defined by the printing data SI.

According to the embodiment, as illustrated in FIG. 4, in the liquid ejecting head 30, nozzle columns Na and Nb are arranged by being inclined to the Y direction which is a transport direction of the printing medium P by an angle θ (oblique head). For this reason, the plurality of virtual nozzles Un which become a non-ejecting unit are arranged at a positive end portion of the nozzle column Na, and similarly, the plurality of virtual nozzles Un are arranged at a negative end portion of the nozzle column Nb.

Figure 16:
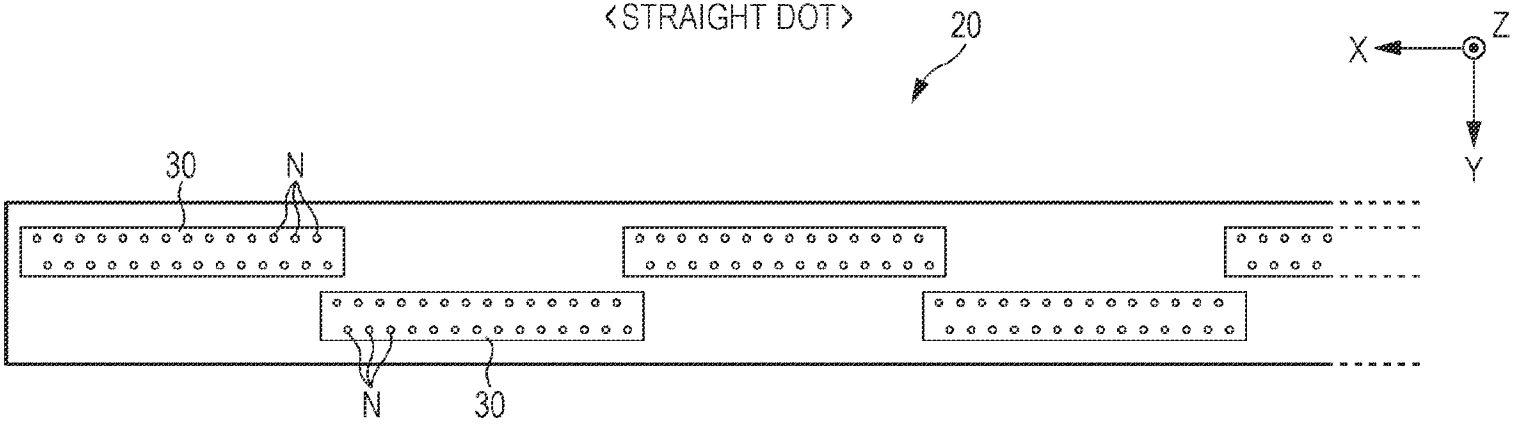
FIG. 16 is a plan view of a liquid ejecting module according to a separate example.

In such an inclined arrangement, when the angle θ is changed due to a design or a specification, there is a possibility that the number of virtual nozzles Un may be changed. For example, when a high resolution is necessary, the liquid ejecting head 30, a configuration in which the nozzle columns Na and Nb are arranged in a direction orthogonal to the transport direction of the printing medium P (straight head), as illustrated in FIG. 16 is also taken into consideration. In the configuration, it is not necessary to provide a non-ejecting unit in the liquid ejecting head 30, the virtual nozzle Un is changed to a nozzle N which can eject ink droplets, and it is necessary to supply printing data SI which defines an ejecting amount of ink (size of dot) by corresponding to all of nozzles N.

However, even when the oblique head is changed to the straight head, in the control section 100, a process in which, in the printing data SI which corresponds to the nozzle numbers "d1" to "d4", data which defines non-recording (0, 0) as a dummy signal is replaced by data which defines a size of a dot to be formed is performed. In addition, it is not necessary to perform changes with respect to the wiring substrate 34 and the semiconductor chip 36, and the elements can be shared.

In this manner, according to the embodiment, it is possible to suppress cost since the control section 100, the wiring substrate 34, or the semiconductor chip 36 can be shared when either the oblique head or the straight head is set, and it is significant.

In addition, according to the embodiment, the non-ejecting unit as the virtual nozzle Un may have a configuration in which only the electrode E (E3) corresponds to the non-ejecting unit, and which does not include at least one of the nozzle N, the piezoelectric element Pzt, and the pressure chamber Sc. For this reason, to describe in an extreme manner, the non-ejecting unit may be the same as the ejecting unit which includes the nozzle N, the piezoelectric element Pzt, and the pressure chamber Sc. However, even when the non-ejecting unit have a configuration which can eject ink droplets, it is necessary to set so that ink droplets are not ejected. For this reason, in the printing data SI, it is preferable to set data which designates non-recording as a dummy signal for the non-ejecting unit.

According to the embodiment, the dummy signal of the printing data SI is (0, 0), is data in which the trapezoidal waveform Bdp1 which causes the piezoelectric element to be minutely vibrated is designated in order to prevent thickening of ink in the first half period T1, and which designates a constant waveform using a voltage Vc so that the piezoelectric element is not displaced in the second half period T2; however, the dummy signal may be substituted, may not displace the piezoelectric element Pzt throughout the first half period T1 and the second half period T2, or may designate minute vibration of the piezoelectric element.

In addition, in the embodiment which is illustrated in FIG. 9, the configuration in which driving signals COM-A and COM-B are output, respectively, in the driving circuits 50-*a* and 50-*b* is set for ease of explanation; however, it may be a configuration in which, even when a driving circuit which outputs driving signals COM-C, COM-D, . . . is further provided, any one of the large number of driving signals is extracted, and is distributed to the piezoelectric element Pzt. By adopting such a configuration, it is possible to easily perform multiple gradation.

What is claimed is:

1. A liquid ejecting apparatus comprising:

a wiring substrate; and a liquid ejecting head, wherein the liquid ejecting head includes a plurality of electrodes, an ejecting unit, and a non-ejecting unit, wherein the wiring substrate is connected to the plurality of electrodes, and a signal waveform in which predetermined printing data is designated is applied to the electrodes through the wiring substrate, wherein the ejecting unit includes a driven element which is displaced due to the signal waveform which is applied to an electrode which is provided so as to correspond to at least one of the plurality of electrodes, a pressure chamber of which an internal volume is changed due to the displacement of the driven element when the inside is filled with liquid, and nozzles which are provided in order to eject liquid in the pressure chamber according to the change of the internal volume of the pressure chamber, wherein the non-ejecting unit is provided so as to correspond to at least another electrode among the plurality of electrodes, and does not include at least one of the nozzle, the driven element, and the pressure chamber, wherein the plurality of electrodes are arranged at a predetermined pitch along a predetermined direction, and the signal waveform which is applied to the electrode which corresponds to the non-ejecting unit is designated by a dummy signal in the printing data, and wherein the signal waveform which is applied to the electrode which corresponds to the non-ejecting unit does not cause any driven element of the non-ejecting unit to be displaced, or causes said any driven element to be vibrated only minutely such that the vibration does not cause ink to be ejected from the liquid ejecting head.

2. The liquid ejecting apparatus according to claim 1, further comprising:

a control unit; and a distribution unit, wherein the control unit outputs the printing data by multiplexing the data, wherein the distribution unit distributes the multiplexed printing data to each of the ejecting unit and the non-ejecting unit, respectively, and wherein the signal waveform corresponding to the distributed printing data is applied to each of the electrode which corresponds to the ejecting unit, and the electrode which corresponds to the non-ejecting unit.

3. The liquid ejecting apparatus according to claim 1, wherein the nozzles are arranged along a first direction which intersects an orthogonal direction of a transport direction of a printing medium onto which the liquid is ejected.

4. The liquid ejecting apparatus according to claim 3, wherein the nozzles are arranged in two columns of a first group and a second group along the first direction, and wherein the nozzles of the first group and the nozzles of the second group are located on a virtual line along a direction in which the printing medium is transported.

5. A control method of a liquid ejecting apparatus which includes a wiring substrate; and and a liquid ejecting head, in which the liquid ejecting head includes a plurality of electrodes, an ejecting unit, and a non-ejecting unit, in which the wiring substrate is connected to the plurality of electrodes, and a signal waveform in which predetermined printing data is designated is applied to the electrodes through the wiring substrate, in which the ejecting unit includes a driven element which is displaced due to the signal waveform which is applied to an electrode which is provided so as to correspond to at least one of the plurality of electrodes, a pressure chamber of which an internal volume is changed due to the displacement of the driven element when the inside is filled with liquid, and nozzles which are provided in order to eject liquid in the pressure chamber according to a change in internal volume of the pressure chamber, in which the non-ejecting unit is provided so as to correspond to at least another electrode among the plurality of electrodes, and does not include at least one of the nozzle, the driven element, and the pressure chamber, and in which the plurality of electrodes are arranged at a predetermined pitch along a predetermined direction, the method comprising:

designating the signal waveform which is applied to an electrode which corresponds to the non-ejecting unit by a dummy signal in the printing data, wherein the signal waveform which is applied to the electrode which corresponds to the non-ejecting unit does not cause any driven element of the non-ejecting unit to be displaced, or causes said any driven element to be vibrated only minutely such that the vibration does not cause ink to be ejected from the liquid ejecting head.

6. A program which causes a computer which controls a liquid ejecting apparatus to execute a function of designating a signal waveform which is applied to an electrode which corresponds to a non-ejecting unit by a dummy signal in printing data, in which the liquid ejecting apparatus includes a wiring substrate; and and a liquid ejecting head, wherein the liquid ejecting head includes a plurality of electrodes, an ejecting unit, and a non-ejecting unit, wherein the wiring substrate is connected to the plurality of electrodes, and the signal waveform in which predetermined printing data is designated is applied to the electrodes through the wiring substrate, wherein the ejecting unit includes a driven element which is displaced due to the signal waveform which is applied to an electrode which is provided so as to correspond to at least one of the plurality of electrodes, a pressure chamber of which an internal volume is changed due to the displacement of the driven element when the inside is filled with liquid, and nozzles which are provided in order to eject liquid in the pressure chamber according to a change in internal volume of the pressure chamber, wherein the non-ejecting unit is provided so as to correspond to at least another electrode among the plurality of electrodes, and does not include at least one of the nozzle, the driven element, and the pressure chamber, wherein the plurality of electrodes are arranged at a predetermined pitch along a predetermined direction, wherein a signal waveform which is applied to an electrode which corresponds to the non-ejecting unit is designated by a dummy signal in the printing data, and when applied to the electrode does not cause any driven element of the non-ejecting unit to be displaced, or causes said any driven element to be vibrated only minutely such that the vibration does not cause ink to be ejected from the liquid ejecting head.

* * * * *